United States Patent [19]

Thelissen

[11] 4,025,141

[45] May 24, 1977

[54] ELECTRICAL CONNECTOR BLOCK

[75] Inventor: Guillaume Francois Gustave Thelissen, 's-Hertogenbosch, Netherlands

[73] Assignee: E. I. Du Pont de Nemours and Company, Wilmington, Del.

[22] Filed: Jan. 28, 1976

[21] Appl. No.: 653,086

[52] U.S. Cl. ..... 339/99 R
[51] Int. Cl.[2] ..... H01R 9/08
[58] Field of Search ..... 339/97–99

[56] References Cited

UNITED STATES PATENTS

| | | | |
|---|---|---|---|
| 3,432,799 | 3/1969 | Richards et al. | 339/99 R |
| 3,768,067 | 10/1973 | Rault | 339/99 R |

*Primary Examiner*—Joseph H. McGlynn

[57] ABSTRACT

An insulation piercing electrical connector block for a flat ribbon cable includes a base, a cover engageable with the base, and a guide block interengageable between the base and the cover for guiding and spacing alternate conductors in the cable and alternately terminating conductors in the cable as signal and ground terminations.

1 Claim, 6 Drawing Figures

Fig. 3
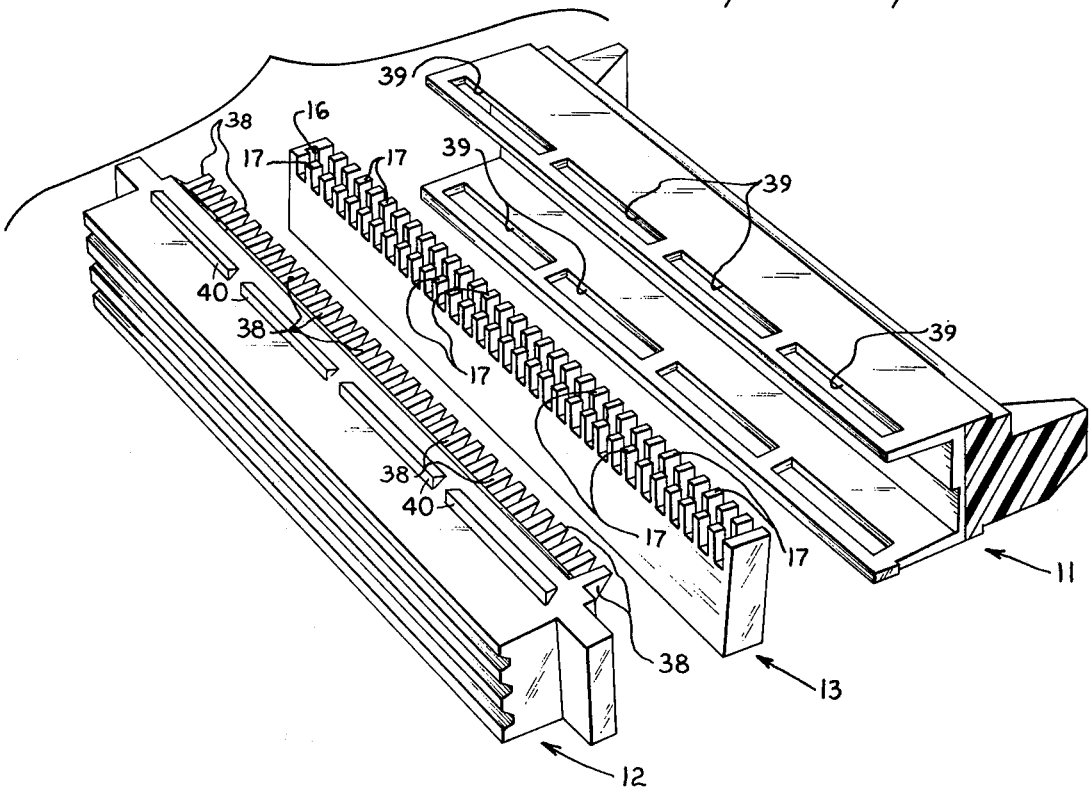
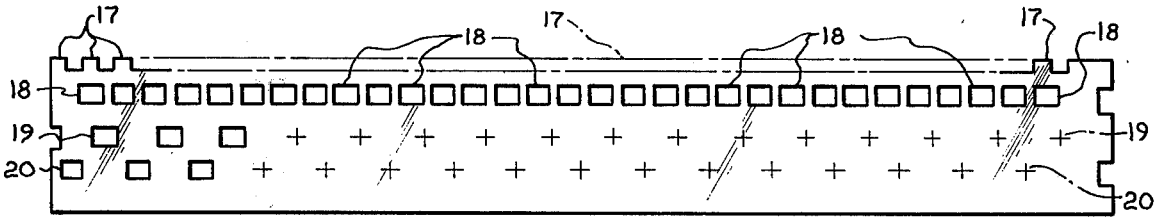
Fig. 6

ELECTRICAL CONNECTOR BLOCK

BACKGROUND OF THE INVENTION

1. Field of the Invention

This invention relates to electrical connector blocks and particularly to insulation-piercing electrical connector blocks for flat ribbon cable. More particularly, the invention relates to insulation-piercing connector blocks including a guide block for guiding and spacing conductors in a cable and alternately terminating conductors in a cable as signal and ground terminations.

2. Description of the Prior Art

Insulation-piercing electrical connector blocks using bifurcated contacts or tines for forming electrical connections are described in U.S. Pat. Nos. 3,012,219 and 3,820,058. The connector blocks in these patents include one or more rows of insulation piercing contacts for individual signal or common termination of individual conductors or a multi-conductor ribbon cable. Also, a number of connector blocks are known in the prior art for common or ground termination of alternate drain conductors or a ground plane in a multi-conductor flat ribbon cable. Such connector blocks are described in U.S. Pat. Nos. 3,634,806; 3,731,251; 3,864,011; and 3,912,354.

Individually shielded and multi-conductor cables with a ground plane provide advantages over unshielded multi-conductor cable by reducing spurrious electrical noise and cross-talk between adjacent conductors, however such cables are expensive and termination of the signal and ground conductors or ground plane is complicated. An alternative to such expensive cables can be provided by using conventional unshielded multi-conductor cable and commonly terminating alternate conductors in the cable to reduce spurious electrical noise and cross-talk between alternate signal conductors in a cable.

The connector block of the present invention provides for rapid common termination of alternate conductors as ground and signal conductors and substantially reduces spurious electrical noise and cross-talk between signal conductors in an unshielded multi-conductor cable.

SUMMARY OF THE INVENTION

According to the present invention, an electrical connector block for a flat, ribbon, cable is provided comprising a base, a cover engageable with the base, and a guide block interengageable between the base and the cover for guiding and spacing alternate conductors in the cable and alternately terminating conductors in the cable as signal and ground terminations. Preferably, the base includes an L-shaped transverse slot for receiving the cable, the cover includes a plurality of terminal-receiving cavities, each cavity having a terminal including an insulation-piercing contact extending therefrom towards the base; and the guide block includes a central transverse slot having an opening in alignment with the L-shaped slot in the base at one end of the slot for receiving the cable, a pair of spaced ribs at the other end of the slot, and two or more rows of longitudinal apertures extending through the guide block between the base and the cover for receiving the insulation-piercing contacts extending from the cover; each aperture of one of the rows of apertures spaced corresponding with the spaced ribs on the guide block, and each aperture of the other rows alternately spaced with regard to the spaced ribs. Preferably, the cover includes a plurality of spaced fins for engaging and separating ends of alternate conductors and clamping the alternate ends of the cable.

BRIEF DESCRIPTION OF THE DRAWINGS

FIG. 3 is a perspective view of an embodiment of a connector block according to the invention unassembled.

FIG. 6 is a top view of an embodiment of a guide block of the invention.

DETAILED DESCRIPTION OF A PREFERRED EMBODIMENT

A preferred embodiment of a connector block according to the present invention is described with reference to the attached drawings in which the same numerals are used to describe the same elements throughout the various views.

A connector block 10 according to the invention comprises a base 11, a cover 12 engageable with the base 11, and a guide block 13 interengageable between the base 11 and cover 12.

Figure 2:
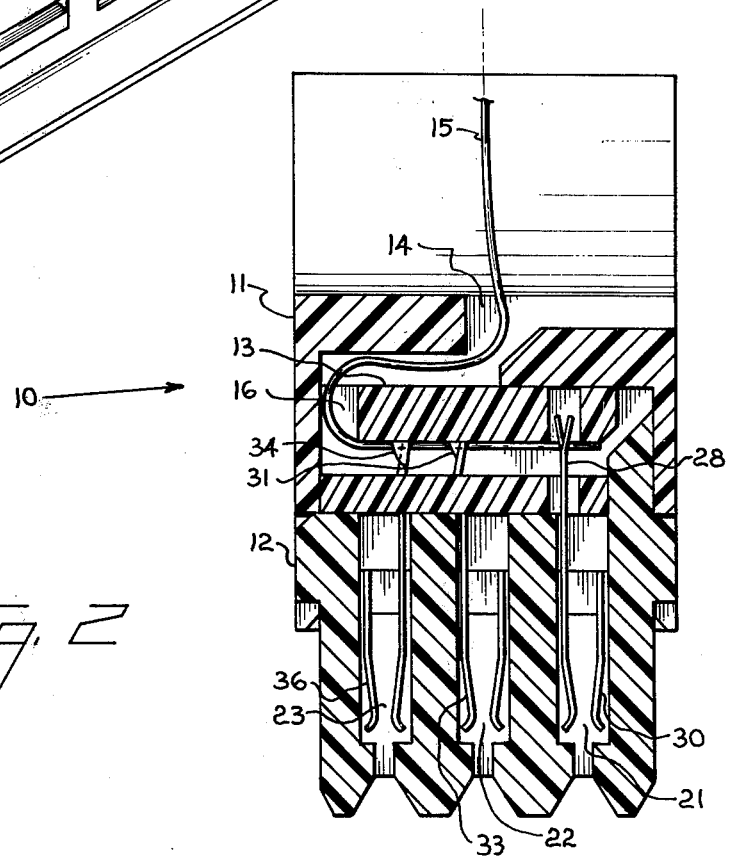
FIG. 2 is a side elevation view in section along line 2—2 of FIG. 1.

In the base 11 there is a receiving slot 14 for a flat cable. As illustrated in FIG. 2, the cable 15 is guided through an L-shaped slot 16 through guide block 13. The guide block 13 has rows of apertures 18, 19 and 20 extending through the block for receiving the piercing contacts intersecting the slot 16. The slot 16 supports the cable 15 during piercing of the insulation of the individual conductors. The cover 12 has a plurality of rows of terminal receiving cavities 21, 22 and 23 for receiving, respectively, insulation piercing contacts 28, 31 and 34 having female receptacles 30, 33 and 36.

Figure 4:
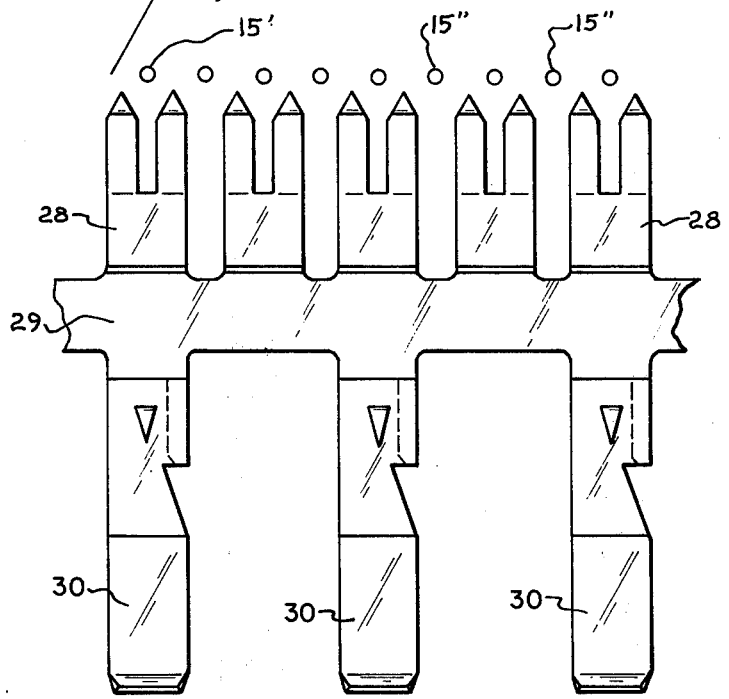
FIG. 4 is a view of an embodiment of a plurality of commonly connected insulation piercing contacts of the connector block.

As illustrated in FIG. 4, the piercing contacts 28 are regularly spaced corresponding to the spacing between alternate conductors in the cable 15 and connected to each other by a bus strip 29. The bus strip 29 includes a plurality of female receptacles 30 alternately spaced with regard to each insulation piercing contact 28.

Figure 5:
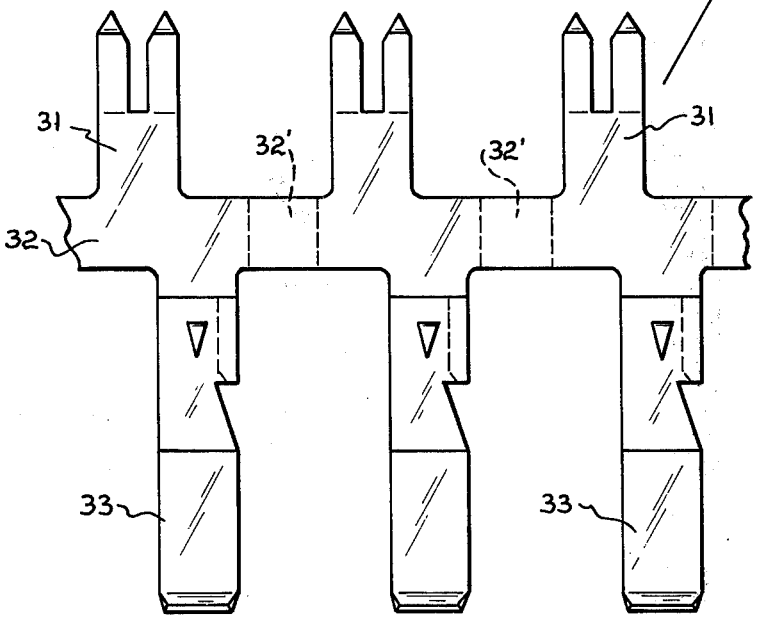
FIG. 5 is a view of an embodiment of a plurality of signal terminal insulation piercing contacts.

As illustrated in FIG. 5, the row of piercing contacts 31 is conventionally formed, e.g. by die stamping, in strip form with a bus strip 32 connecting the piercing contact 31 with a laterally offset female receptacle 33. The row of piercing contacts 31 is for terminating one half of the signal conductors, and the spacing between the piercing contacts 31 is twice that of the spacing of the piercing contacts 28. The corresponding female receptacles 33 have the same spacing as the insulation piercing contacts 31, but are laterally offset to provide for the female receptacle 33 in a row with female receptacles 30 of the ground or common terminations. During assembly of the contacts 31 and insertion of the female receptacles 33 in the cavities 19 in the cover 12, the bus strip is blanked to remove portion 32' and provide for individual termination of each contact 31 and a signal conductor 15'' in the cable.

The second row of insulation piercing signal contacts 34 and the female receptacles 36 are identical to contacts 28 and receptacles 33, but are rotated 180° with respect to the row of contacts 28, so the insulation-piercing contact 34 will provide for termination of the other half of the signal conductors 15'' in the cable 15 and the female receptacles 36 will be in a row with respect to receptacles 33 and 30. During assembly of contacts 34 and insertion of the female receptacles 36 in the cavities 20 in the cover 12, the bus strip is blanked to remove portion 32' and provide for individual termination of each contact 34 and a signal conductor 15'' in the cable.

The guide block 13 has two rows of spaced ribs 17 at one end on opposite sides of slot 16. The spacing of the ribs 17 corresponds with twice the pitch or spacing of the conductors in a flat ribbon cable. The ribs 17 cooperate with fins 38 provided in the cover 12. The fins 38 have the same spacing as ribs 17 and are displaced to interengage with the ribs 17 when the base 11, cover 12 and guide block 13 are assembled. During assembly, the alternate ground conductors in the cable are supported by the ribs 17 and signal conductor ends are separated by the fins 38 from the ground conductor ends and displaced. This increases the distance between the ends of the signal and ground conductors and clamps and seals the end of the cable.

The connector block 10 is assembled by inserting the cable 15 through slot 14 in the base 11, and L-shaped slot 16 in guide block 13 until the end of the cable is flush between each row of spaced ribs 17 at one end of slot 16. The guide block 13 and cable 15 is retracted into base 11 and the cover 12 is engaged with the base 11 so they interengage the guide block 13 and the various rows of insulation contacts commonly terminate alternate ground conductors and individually terminate signal conductor in the cable. When the cover 12 is fully inserted in the base, the locking slots 39 in the side walls of base 11 engage and latch with the cam bars 40 on each side of the cover 12 locking the connector block 10 together.

In the preferred embodiment of the connector block of the invention, the insulation piercing contacts comprise a pair of insulation piercing tines as described in U.S. Pat. No. 3,820,058, the disclosure of which is incorporated by reference herein. The tines diverge laterally of each other away from their base and include a female plug comprising a cantilever contact arm for receiving a male terminal.

Figure 1:
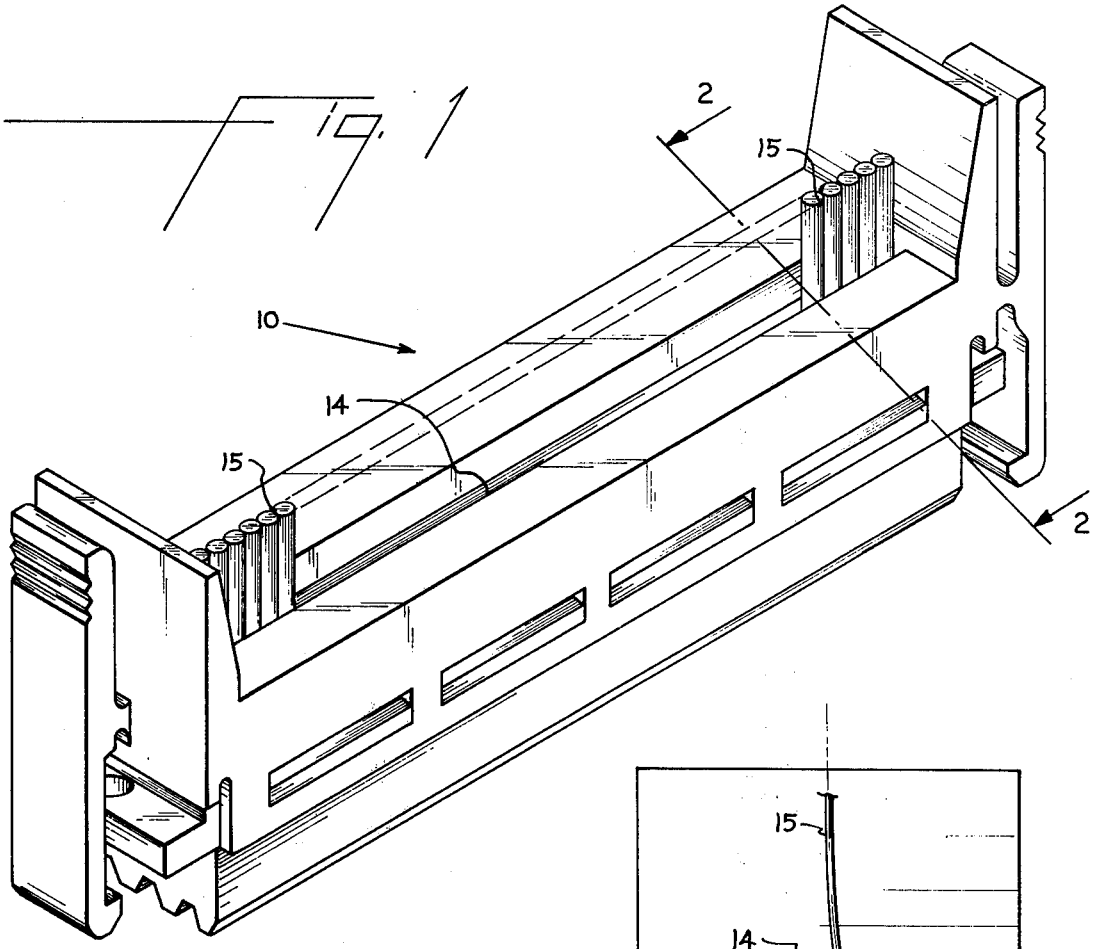
FIG. 1 is a perspective view of an embodiment of a connector block according to the invention.

The base 11 and cover 13 may be provided with convention latch arms and panel mounts as illustrated in FIG. 1. The base 11, cover 12 and guide block are preferably molded of a suitable plastic insulating material.

I claim:

1. In an electrical connector block for a flat, ribbon cable comprising a base including a transverse slot for receiving a cable, a cover engageable with the base including a plurality of terminal receiving cavities, each cavity having an insulation piercing contact mounted therein, and a guide block interengageable between the base and the cover; the improvement comprising said guide block including a central transverse slot having an opening in alignment with said slot in the base at one end of said slot for receiving the cable, and two rows of spaced ribs at the other end of said slot for recieving and supporting alternate ground conductors in the cable, and the cover including a plurality of fins engageable between said spaced ribs in said block for separating and clamping alternate signal conductors in the cable.

* * * * *